United States Patent [19]

Kamigaito et al.

[11] 3,967,230

[45] June 29, 1976

[54] RESISTOR BUILT-IN SPARK PLUG

[75] Inventors: Osami Kamigaito; Haruo Doi; Hideyuki Masaki; Toshio Kandori; Masami Oki; Yasuo Nakamura, all of Nagoya, Japan

[73] Assignees: Nippondenso Co., Ltd.; Kabushiki Kaisha Toyota Chuo Kenkyusho, both of Japan

[22] Filed: Oct. 22, 1974

[21] Appl. No.: 517,053

[30] Foreign Application Priority Data

Nov. 12, 1973 Japan ..... 48-127032

[52] U.S. Cl. ..... 338/66; 123/148 P; 123/169 R

[51] Int. Cl.[2] ..... H01C 1/06; H01C 7/06

[58] Field of Search ..... 338/66; 123/148 P, 169 R, 123/148 R; 29/25.12

[56] References Cited

UNITED STATES PATENTS 2,371,211 3/1945 Barrington ..... 338/66

2,436,644 2/1948 Halstead ..... 338/66

*Primary Examiner*—C. L. Albritton

*Attorney, Agent, or Firm*—Cushman, Darby & Cushman

[57] ABSTRACT

A resistor built-in spark plug comprises an insulator formed with an axially extending inner hole, a stem fitted in the upper part of said hole in said insulator, a center electrode fitted in the lower part of said hole, a resistor disposed in the central part of said hole, and copper-glass electrode layers disposed between said resistor and said stem and between said resistor and said center electrode. Said resistor is made by firing and solidifying powder of resistor mixture consisting of 75 to 38 volume percent of main resistor component containing tin oxide and 25 to 62 volume percent of glass powder with softening temperature of 300° to 600°C. Said copper-glass electrode layers are made by firing and solidifying a mixture of copper powder and glass powder with the softening temperature of above 530°C and more than 30°C higher than the softening point of glass in the resistor portion.

12 Claims, 3 Drawing Figures

RESISTOR BUILT-IN SPARK PLUG

This invention relates to the improvements in the resistor built-in spark plugs which have noise suppressing effect for the radio wave.

Necessity has been voiced for preventing noise of the communication radio waves by the electric waves produced by the spark plugs. As a measure for preventing such noise, it has been proposed and already commonly practiced to incorporate a resistor in the electric circuit of a spark plug. There are known two methods of incorporating a resistor: setting it in a hole formed in an insulator of the spark plug or setting it in a high-tension wire in the ignition circuit.

The resistivities of the resistors usable for prevention of noise of the radio waves are regulated under the JIS rules into the following three ranges: 5 KΩ ± 30%, 10 KΩ ± 30% and 15 KΩ ± 30%. As regards the properties of the resistors, the rate of change of resistivity after the spark discharge test and the heating test is also regulated. That is, it is ruled that the change of resistivity after 250 hours of spark discharge must be less than +25% and −40% of the respective resistivities in said three defined ranges, and that the change of resistivity after heating to 350°C and then cooling must be less than ± 25% of said resistivities.

There have heretofore been proposed various types of resistors which meet the above-said standard requirements, but most of such resistors have been prepared by shaping and solidifying an electroconductive material with glass for easy incorporation in spark plugs. As such electroconductive material, or the main component of the resistor, is generally used powder of metal (such as copper, iron, nickel, or nickel-chronium alloy) or carbon, or powder of low-resistance metal oxides (such as zinc oxide, barium oxide or nickel oxide). However, the resistors manufactured from such material and glass are low in specific resistance, usually less specimen 0.01 Ω-cm, and the resistors with such low specific resistance show almost no noise suppressing effect because the resistance thereof becomes small value of less than 0.1 Ω. Resistivity of such resistors can be elevated by increasing the amount of glass added, but this means, on the other hand, that such resistivity is subjected to wide change according to increase or decrease of the amount of glass added. Thus, such resistors didn't suit the practical use.

The present inventors have entertained the idea of using the resistant material mainly composed of tin oxide, described in our previous applications Pat. Nos. 47-95439, 47-109724 and 47-112363, as the main component material of resistor used in the spark plugs of the present invention. The resistors obtained by using such component material including tin oxide provide a resistivity of several KΩ to several ten KΩ, which is the level required for practical applications. Further, such value of resistivity is not widely changed according to the amount of glass added in the main component material including tin oxide.

There was however found out a new problem that the resistivity of the resistor varies depending on the properties of glass blended in the main component materiial including tin oxide. This problem is not limited to the material including tin oxide but applies similarly to other materials which have heretofore been used as main components. That is, in case of using glass same as that in the copper-glass layer (mixture of copper powder and glass powder) in the electrode popularly used in manufacture of spark plugs, or in case of using glass which has no much difference in properties from or somewhat worth in fluidity than glass in said copper-glass layer, the interface of said copper-glass layer and the resistor is curved parabolically and the resistivities of the obtained resistors vary widely from one another, so that it is hardly possible to obtain the resistor built-in spark plugs with uniform resistivity. The present inventors have found as a result of numerous tests and experiments that such curving of the interface is ascribed to the difference in the degree of local softening and fluidity between glass in said copper-glass layer in the electrode and glass in the resistor.

In view of the above, the present invention proposes a method of obtaining the improved and very useful resistor built-in spark plugs with limited variations in resistivity, according to which method a reistor mixture consisting of powder of the main component material including tin oxide and glass powder with softening temperature of 300° to 600°C and in an amount of 25 to 62 volume percent of said main component material is placed in a hole formed in an insulator, then a copper-glass layer (for electrode) formed from a mixture of copper powder and glass powder with softening temperature of above 530°C and more than 30°C higher than that of glass in the resistor portion is disposed between said resistor mixture and a middle stem fitted in one part of an inner hole formed in said insulator and between said resistor mixture and the center electrode fixed in said hole on its side opposite from said stem, and then all of these materials are fired so that they are solidified integral with each other.

In the present invention, as a powder mixture containing tin oxide is used as the main component of the resistor, it is possible to obtain a resistor built-in spark plug having resistivity of from 3.5 to 19.5 KΩ which is the level required for effective prevention of noise of radio waves. Particularly, in the present invention, glass with softening temperature of from 300° to 600°C is used as glass added to the powder mixture containing tin oxide, and such glass is blended in an amount of 25 to 62 volume percent to said powder mixture. Also, glass in the copper-glass layers between the powder mixture and middle stem and between said powder mixture and center electrode is of the type that has softening temperature of higher than 530°C. Further, in case the softening temperature of glass in the resistor portion is in the range of 500° to 600°C, glass with softening temperature more than 30°C higher than that of glass in said resistor portion is used as glass in the copper-glass layers. There are therefore obtained the very excellent resistor built-in spark plugs with extremely limited variations of resistivity. The resistivity after the spark discharge test, heating test and engine endurance test is not much different from that before such tests.

The main resistor mixture according to the present invention contains, besides tin oxide, one or more of the following materials: carbon powder, metal oxide metal, antimony oxide, aluminium phosphate, organic binder, and filler.

The reasons for defining the amount of glass powder to be blended in the main resistor mixture, the softening temperature of such glass powder and the softening temperature of glass in the copper-glass layers of electrode will become apparent from the following description.

The present inventors gave particular attention to the causes of curving of the aforementioned interfacial boundary and have found that such curving can be avoided by eliminating the difference in the degree local softening and fluidity between glass in the copper-glass layers and glass in the resistor. For uniformalizing such local softening and flow of glass, there seems available no other way but to either make the resistor itself into a substantially solidified mass or to turn it into a liquid state so that wall surface resistance and flow resistance in the hole in the insulator will become negligibly low as compared with resistance of the copper-glass layers positioned above and below the resistor. The present inventors have first studied the latter method for some reasons combined. In order to give sufficient fluidity to the resistor or filler, it needs to make fluidity of glass used therein better than that of glass used in the copper-glass layers positioned above and below said resistor. Therefore, the kind and composition of glass used in the resistor may vary widely depending on the properties of glass used in the copper-glass layers or the amount of copper powder blended in said layers. However, since the filler, or resistor, and the copper-glass layers of the electrode must be hermetically sealed in the hole formed in the insulator and also the spark plug is exposed to high temperatures in use, either of the glass materials used must have sufficiennt strength to withstand such high temperatures. As already mentioned, in order to make fluidity of glass blended in the resistor portion sufficiently higher (at same temperature) than fluidity of glass blended in the copper-glass layers, it is essential that glass used in the copper-glass layers has a softening point higher than a certain level. Such softening point must be also lower than a certain value, because if the softening point is too high, it becomes impossible to use inexpensive steel material for the middle stem and center electrode.

With these facts in mind, the present inventors have reached the conclusion that glass used in the copper-glass layers should be the type having the softening point of higher than 530°C but preferably not higher than 750°C, such as for example soda-lime glass. If pulverized copper is mixed in glass having the softening point of said range, the softening point of the entire mixture becomes about 20° to 50°C higher than that of glass not yet mixed with pulverized copper. It is essential therefore that the softening point of glass in the resistor is lower than 750°C. As the spark plug is raised in temperature to about 250°C during use, glass in the resistor should obviously have a softening point of higher than 250°C. The above-said range (250° to 750°C) of the softening point of resistor glass shows the values required in principle. Therefore, the actual upper and lower threshold limit temperature are experimentally determined by taking into consideration the amount of glass blended, as further discussed below.

The invention will be further described with reference to the accompanying drawings in which.

Figure 3:
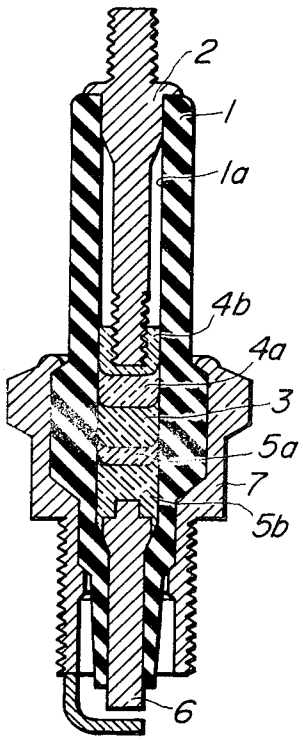
FIG. 3 is a longitudinal sectional view of the resistor built-in spark plug according to the third embodiment of the invention.
Figure 2:
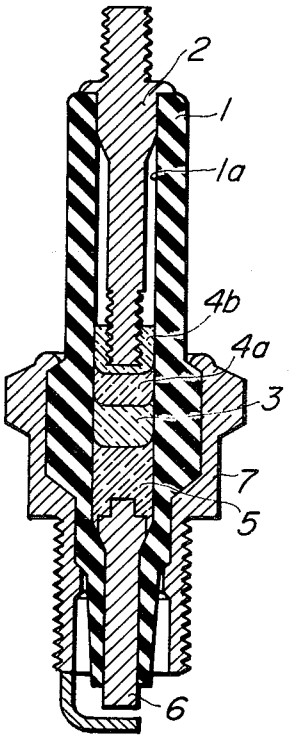
FIG. 2 is a longitudinal secctional view of the resistor built-in spark plug according to the second embodiment of the invention.
Figure 1:
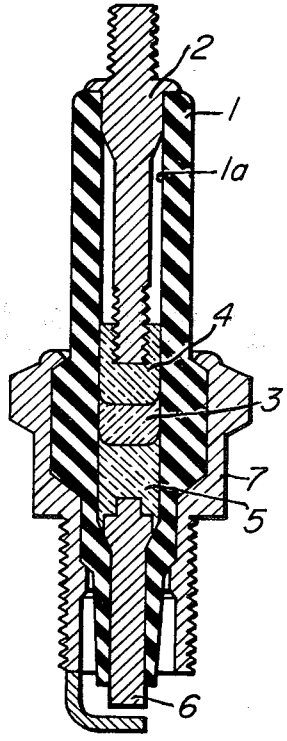
FIG. 1 is a longitudinal sectional view of the resistor built-in spark plug according to the first embodiment of the invention.

The amount of glass to be blended in the main component mixture of the resistor varies depending on whether the resistor is sealedly contained in the spark plug or whether it is placed in solid form in said plug. In the present invention, as the former method is employed as shown in FIGS. 1, 2 and 3, the amount of such blended glass must be sufficient to allow the fine particles themselves of the resistor mixture to adhere strongly to each other and also the resistor 3 thereof to bond to the upper and lower copper-glass layers 4, 5 as well as to the interior surface of the inner hole 1a in the insulator 1. The results of experiments conducted by the present inventors showed that the amount of glass required therefor is 25 to 62 volume percent of the main component mixture.

If the amount of glass blended in the resistor 3 is smaller than 25 volume percent of the component mixture, the resistivity of the obtained resistor built-in spark plugs tends to vary widely after the spark discharge test, engine endurance test and heating test (see Table 2). This is probably because certain movement, fall-off and separation or adhesion take place in the main component mixture due to expansion or contraction caused by temperature change as the glass amount is too small.

It was also found that if the amount of glass blended in the component mixture exceeds 62 volume percent of said mixture, the resistivity of the obtained spark plugs varies widely between the indivisual plugs, and such resistivity could be also sharply lowered or elevated by the sprak discharge (see Table 2). This is considered attributable to the fact that if the amount of glass blended exceeds 62 volume percent, a thick glass film is formed between the adjoining particles of the mixture powder to prevent contact between such indivisual particles, and this probably causes wide variations of resistivity in some cases. It is also considered that when spark discharge is performed, said glass film is broken with flow of current to the spark plug to cause descrease of resistivity, or the relatively thin glass film broken by current flow is melted to cause leakage in the contact portions of the resistor 3 and the copper-glass layers 4, 5 to induce elevation of resistivity.

In either case, the results of our experiments show that the amount of glass to be blended in the component mixture should preferably be within the range of 25 to 62 volume percent of the component mixture no matter what kind of glass is used.

It was also confirmed as a result of numerous experiments that when the amount of glass blended in the component mixture is selected from the above-defined range, the softening point of such glass should preferably be lower than 600°C, although there is actually a lower threshold limit value for such softening point. As aforesaid, the spark plug itself is heated to a high temperature of about 250°C in use, so that when using glass with softening point of around 250°C, the resistor 3 in the insulator is softened to inevitably induce variations in resistivity. Therefore, the lower threshold limit value of softening point of glass used in the resistor 3 is theoretically 250°C, but it actually needs to give a certain safety allowance and hence such lower threshold limit value should, in practice, be 300°C. It was also observed that if the softening temperature of glass used in the resistor exceeds 620°C, no satisfactory fusion-bonding between the resistor portion and insulator can be accomplished by a hot press of the type used in a temperature range safe from causing oxidation of the stem and center electrode, resulting in excessive variation of resistivity by heating. Further, since the softening point of glass in the copper-glass layers is higher than 530°C, if glass with softening point of higher than 530°C is used for the resistor portion, it could happen that the softening point of glass in the copper-glass layer becomes higher than that of glass in the resistor portion. In such cases, variations in resistivity are widened almost without exception, and the yield of the spark plugs that meet the 5 KΩ ± 30 percent range requirement is markedly lowered. It has however admitted that such variations in resistivity can be minimized if suitable glass combination is selected such that the softening point of glass in the copper-glass layers will be more than 30°C higher than that of glass in resistor portion. It was thus found necessary for obtaining excellent spark plugs to select such kind of glass for resistor portion as having the softening point within the range of 300° to 600°C and such kind of glass for the copper-glass layers that its softening point will be more than 30°C higher than that of resistor glass when the softening point exceeds 500°C. In case the softening point of glass in the copper-glass layer is not higher than that of resistor glass by more than 30°C when the softening point of the resistor glass is 500° to 600°C, there was observed a tendency that the interfacial boundaries of the resistor portion and the copper-glass layers are curved, and this is considered responsible for wide variations in resistivity. Such curving of the interfacial boundaries is considered attributable to the fact that fluidity of the copper-glass layers becomes substantially equal to that of the resistor portion to give rise to a flow such as above-said.

The present inventors have also found that if the coefficient of thermal expansion of glass in the resistor 3 and in the copper-glass layers 4, 5 is as high as over $11.3 \times 10^{-6}$/°C, cracks could develop in said resistor portion 3 or in the copper-glass layer portions 4, 5, resulting in a spark plug with extremely high resistivity. This is probably due to shrinkage that was caused in the cooling step after manufacture of the spark plug. It was found that development of such cracks could be controlled to some extent by using a filler with low swelling characteristic. It is however preferable, generally, to use glass with coefficient of thermal expansion of less than $11.3 \times 10^{-6}$/°C. The term "filler" as used here refers to a material (pulverized) having extremely high electric resistivity, such as for example quartz glass, zirconia and zircon. On the other hand, if the coefficient of thermal expansion of glass is too low, strain may be produced in the insulator 1 during the cooling step after manufacture of the spark plug, and such strain may develop cracks in the insulator 1. However, coefficient of thermal expansion of glass is usually not so low, so that, actually, there is little possibility of obtaining and using glass with such low coefficient of thermal expansion as could cause cracks. No crack developed in the low-expansibility glass ($\alpha = 4.3 \times 10^{-6}$/°C) that the present inventors could obtain, so if judging merely from the aspect of cracking, it is possible to use glass with coefficient of thermal expansion ($\alpha$) of up to $4.3 \times 10^{-6}$/°C. Further, if a high expansibility material is used as filler, since high expansibility is maintained during the cooling step of the obtained spark plug, shrinkage is promoted to form pores in the resistor portion and such pores prove helpful to lessen thermal stress. Also, greater strength can be assured by increasing the glass thickness. Thus, substantially no particular restriction is imposed by the low coefficient of thermal expansion of glass used.

Referring here to the drawings, FIG. 1 shows the construction of a resistor built-in spark plug in which the copper-glass layers 4, 5 of the electrode are disposed one above and the other below the resistor 3. In study of this construction, the present inventors have found that if the copper-glass layer 4 positioned above the resistor 3 is divided into two layers **4*a* and 4*b* as shown in FIG. 2 and if the first layer 4*a* contacted with the resistor 3 is blended with greater amount of copper than that blended in the second layer 4b which is in contact with the middle stem 2, the variations in resistivity of the obtained resistor built-in spark plugs are significantly limited as compared with those observed when using high expansibility glass in the resistor of the spark plug with the construction of FIG. 1 even if coefficient of expansion of glass in the resistor 3 is high (see Tables 2 and 4). It was also found as a result of numerous experiments by the present inventors that if the copper-glass layers and resistor 3 in the hole 1a in the insulator 1 are arranged in five layers as shown in FIG. 3, that is, if each of the copper-glass layers on both upper and lower sides of the resistor 3 is bisected to form the first, second, third and fourth copper-glass layers 4*a*, 4*b*, 5*a* and 5*b*, and if the first and third layers 4*a* and 5*a* in contact with the resistor 3 are blended with a greater amount of copper than that blended in the second and fourth layers 4*b* and 5*b* which are contacted with the stem 2 and the center electrode 6, respectively, the variations in resistivity can be even more diminished. The above-described results can be obtained by using lead borate glass, zinc borate glass, lead glass, zinc-soda glass or the like as glass in the resistor 3 in the resistor built-in spark plug of the construction shown in FIG. 2 or FIG. 3.**

The present invention is now described in further detail by way of some preferred embodiments thereof, but these embodiments are by no means restrictive but merely illustrative of the present invention.

FIRST EMBODIMENT

There were prepared various types of glass powder specimens (No. 1 to No. 22) (all passing 200-mesh screen) as shown in Table 1. There was also prepared powder of main component mixture of resistor (hereinafter referred to as main resistor mixture) containing tin oxide added with 3 wt percent of antimony oxide and 10 wt percent of tantalum oxide, then burned at 1200°C and then pulverized. A suitably measured amount of each of said various types of glass powders and said main resistor mixture were collected and then mixed well in a ball mill. There was further prepared mixture powder comprising 50 wt percent of copper powder (all passing 200-mesh screen) and 50 wt percent of each of glass specimens shown in Table 1 (such mixture being hereinafter referred to as 50-copper-glass mixture).

In the meanwhile, there were also prepared alumina-made insulators 1 (inner diameter 4.8 $\phi$), center electrodes 6 and middle stems 2 such as shown in FIG. 1. First, a center electrode 6 was inserted bottomwise into an inner hole 1a in the insulator 1, and then about 0.2 gr of 50-copper-glass mixture powder was charged into said hole 1a in the insulator 1 and a pressure of about 50 kg/cm² was applied to said 50-copper-glass mixture by using a press to flatten the top surface of the mixture. Then about 0.5 gr of mixture of said main resistor mixture powder and glass powder was poured onto said copper-glass layer and again a pressure was applied thereto to flatten the top surface thereof. Then, again, about 0.3 gr of 50-copper-glass mixture powder was charged onto said mixture, followed by topwise insertion of a stem 2 into said hole 1a and application of pressure to said stem 2. Thereafter, the insulator 1 was placed in a furnace which consists of an electric heater of silicon monoxide (so-called siliconit) and is maintained at high temperature of 890°C, and after left therein for about 30 minutes, said insulator was taken out and a pressure of about 200 kg was applied to the stem 2 by a press to effect bonding and compression of the particles loaded in the inside of the insulator. This final operation turned the 50-copper-glass mixture on the center electrode 6 into a copper-glass layer 5, the mixture of main resistor mixture powder and glass powder into a resistor 3, and the 50-copper-glass mixture contacting the stem 2 into a copper-glass layer 4 of the electrode. After cooling the insulator 1, a housing 7 was mounted around said insulator to obtain a resistor built-in spark plug.

100 pieces of spark plugs were manufactured by following the same process as described above for each of the glass specimens (No. 1 to No. 22) of Table 1, and the following matters were examined over each 100-piece group of the obtained spark plugs: per cent defectives (or the rate of the articles whose average resistivity and JIS regulated resistivity were outside the range of 5 KΩ ± 30 percent), increase (in percentage) of the average resistivity after 1-minute spark discharge over the average resistivity before the test, increase (in percent) of the average resistivity after 1-minute spark discharge test, heating to 250°C and then cooling over the average resistivity before the test, and increase (in percent) of the average resistivity after engine endurance test (conducted by attaching the device directly to the engine) over the average resistivity before the test. The results are shown in Tables 2-1 to 2-3. The substantial length of the resistor 3 in each of the spark plugs obtained by the above-said method is approximately 7 mm if the interfacial boundaries of the resistor 3 and the copper-glass layers 4, 5 of the electrode are flat. As apparent from Tables 2-1 to 2-3, if the amount of glass blended is greater than 62 volume percent of the main resistor mixture, the resistivities of the obtained spark plugs vary widely from plug to plug and such resistivities are also greatly changed by the spark discharge test, irrespective of the composition of glass used in manufacture of the resistor 3. To be more concrete, if No. 5 specimen of Table 1 is used as glass for the resistor 3 and this glass is blended in an amount of 63 volume percent of the main resistor mixture, the defectives (or the articles whose resistivity is outside of the range of 5 KΩ ± 30 percent, one of the resistivity ranges regulated by JIS) accounts for 63 percent of the entire products. This means that 63 out of every 100 articles obtained are defective. It will be understood from this fact that the resistivities of the obtained products vary so widely from product to product. It is to be also noted that the average resistivity after one-minute spark discharge test shows an 8 percent increase over the average resistivity before the test, while that after the engine endurance test shows a 10 percent increase. On the other hand, if the amount of glass blended is smaller than 25 volume percent of the main resistor mixture, there is also observed a tendency that the resistivities of the obtained spark plugs vary widely from plug to plug and such resistivity also undergoes wide variation after the heating test conducted by heating each article to 250°C after one-minute spark discharge test. To put it more concretely, if glass of specimen No. 5 in table 1 is used as glass component of the resistor and this glass is blended in an amount of 20 volume percent of the main resistor mixture, the obtained spark plugs with resistivities outside the range of 5 KΩ ± 30 percent accounts for 80 percent of the entire products, which shows how wide are the variations in resistivities of the obtained articles. Also, the average resistivity after the heating test shows as much as 25 percent increase over the average resistivity before the test. These results dictate that the amount of glass used in the resistor should preferably be within the range of 25 to 62 volume percent of the main resistor mixture. However, even if glass is used in an amount within said range, although the resistivity variation after the spark discharge test, heating test and engine endurance test is significantly limited, it is noted (as apparent from Tables 2-1 to 2-3) that the resistivities of the indivisual spark plugs still differ widely from one another, notwithstanding the fact that the amount of glass blended is within the above-said range (25 to 62 volume percent). This is indicative of the fact that the softening point of glass used in the resistor exerts as great influence to the spark plug resistivity as the amount of glass blended.

As apparent from Tables 2-1 to 2-3, if glass of specimen Nos. 3, 10, 11, 13, 18 and 22 is used for the resistor, the resistivities of the obtained spark plugs are greatly changed after the heating and engine tests. Upon examining the interior of these spark plugs by cutting them, it was found that, in each of them, the resistor portion was not well fused to the insulator, allowing development of cracks when expansion or contraction takes place with heating. All of the above-mentioned types of glass are high in softening point, so that it is considered that when subjected to hot press, glass is restricted in its range of flow to make it hard to accomplish satisfactory fusion bonding. Of course, desired fusion bonding can be achieved if the hot press temperature is sufficiently elevated, for instance to 1,000°C, but such high temperatures cause oxidation of the stem and center electrode, and hence it is practically impossible to select such high temperatures.

On the other hand, when using glass of specimen Nos. 1, 2, 9, 12, 17 and 21 for the resistor portion, the obtained results may provide unsatisfactory depedning on the type of glass used in the copper-glass layers, even if the amount of glass blended is within the range of 25 to 62 volume percent. That is, if the combination of glass used in the copper-glass layers and glass used in the resistor portion is No. 9 - No. 21, No. 2 - No. 17, No. 1 - No. 1, No. 2 - No. 1, No. 9 - No. 1, No. 2 - No. 2, No. 21 - No. 9, No. 1 - No. 12, No. 2 - No. 17 or No. 9 - No. 21, the rate of change in both spark discharge test and heating test is about 7 percent at highest, which is not so bad as compared with other combinations. However, the resistivities of the 100 pieces of spark plugs manufactured vary widely from plug to plug, and as the results showed, the rate of the spark plugs whose resistivities were outside the range of 5 KΩ ± 30 percent was about 50 percent. Examination of these spark plugs revealed that the interfacial boundaries of the resistor portion and the copper-glass layers are curved and that the degree of such curving is not constant. In these spark plugs, the softening point of glass in the resistor portion differs by less than 10°C from that of glass in the copper-glass layers, or the former is higher than the latter. In these combinations, it is considered that bad flow in the resistor portion is responsible for the above-said results as expected at the beginning. On the other hand, even when using glass of specimen Nos. 1, 2, 9, 12, 17 and 21, if the softening point of glass in the copper-glass layers is higher by more than 30°C than that of glass in the resistor portion, excellent results are obtained, or at least better results are obtained than when using glass with smaller temperature difference. Interior examination of these spark plugs revealed flat interfacial boundaries indicative of excellent properties of the products. These results show that the softening point of glass used in the resistor portion should be lower by more than 30°C than that of glass used in the copper-glass layers. It is also noted from Table 2-1 that if glass of specimen No. 4 is blended in the main resistor mixture in an amount of 50 volume percent of said mixture, the average resistivity after the engine endurance test shows an increase of 20 percent of the average resistivity (5.8 KΩ) before the test, and also change of resistivity after the spark discharge test and the heating test is very limited. The softening point of glass of No. 4 is 360°C. Although not shown in Table 2, the results of experiments by the present inventors have also revealed that the variations in resistivities and change of resistivity after each test are limited within a very small scope even if the softening point of glass used is 300°C. The reason for defining the softening point to not lower than 300°C will be evident from the foregoing description, too. Anyway, the most preferred range of softening point of glass used in the resistor is from 300° to 600°C. Thus, it is preferred that the amount of glass used in the resistor is within the range of 25 to 62 volume percent of the main resistor mixture and that the softening point of glass used therefor is within the range of 300° to 600°C. It is also desirable that softening point of glass used in the copper-glass layers of electrode is higher than 530°C and that when using glass with softening point of higher than 500°C for the resistor portion, glass used in the copper-glass layers has the softening point 30°C higher than that of glass used in the resistor portion. It is also noted from Tables 2-1 and 2-2 that when using glass with coefficient of thermal expansion of greater than $11.3 \times 10^{-6}$/°C for the resistor, there are observed certain cases where the degree of scatter of resistivities or fraction defective is high although the glass used meets the above-said definitions, bu generally, the scatter of resistivieies is limited and good results are obtained if the above-said definitions are met. Even when glass with thermal expansion coefficient of greater than $11.3 \times 10^{-6}$/°C is used for the resistor under the above-said conditions, it is possible to reduce the scatter of resistivities to certain extent as discussed in the following second and third embodiments which are modifications of the foregoing first embodiment of the invention. As viewed above, there are provided according to the present invention the excellent resistor built-in spark plugs which are generally low in the scatter of resistivities and in which change of resistivity after the spark discharge test and heating test is less than 10 percent and that after the engine endurance test is less than 8 percent.

Now, a modification of the above-described first embodiment of the present invention is described.

As shown in Table 3, there were prepared quartz glass powder (all passing 200-mesh screen), zirconia powder (all passing 200-mesh screen) and zircon powder (all passing 200-mesh screen) as filler, and the main resistor mixture powder (all passing 200-mesh screen) containing tin oxide ($SnO_2$) added with 3 wt percent of $Sb_2O_3$ and 3 wt percent of $Ta_2O_5$. There were also prepared powders (all passing 200-mesh screen) of glass of specimen Nos. 1, 3, 4, 5, 8, 12, 14 and 20 in Table 1. Then these powders were mixed in suitable amounts and combinations and the resistor built-in spark plugs were manufactured by following the same steps as the first embodiment. The resistivities of these spark plugs and the results of tests conducted on these plugs after the fashion of the first embodiment are also shown in Table 3. As seen in the same table, if the amount of glass used is within the range of 25 to 62 volume percent of the mixture of tin oxide-containing main resistor mixture and filler and the softening point of such glass is less than 600°C, variations in resistivities of the obtained spark plugs are limited and also change of resistivity after the spark test, heating test and engine endurance test is very small as in the case of the first embodiment. If a low-expansibility filler (such as quartz glass) is used, the fraction defectives, or the rate of articles whose resistivities are outside the range of 5 KΩ ± 30% (3.5 – 6.5 KΩ) is 20 percent, that is to say, the number of defective articles is 20 out of every 100 articles produced, even when using glass with high expansion coefficient such as glass of specimen No. 14 ($\alpha = 14.0 \times 10^{-6}$/°C). This is a marked improvement over 45 percent defective rate of the articles using glass of speccimen No. 14 in Table 2-1. The same is true of glass of specimen No. 20 if such glass is used in an amount of 41 volume percent of the main resistor mixture containing tin oxide. Thus, high coefficient of thermal expansion of glass used in the resistor is not an inherent defect, and it is apparent that such problem can be avoided by employing a suitable means, for example by use of a filler. Therefore, the fact that use of filler can minimize variations in resistivities implies that resistivity of the resistor can be changed by use of a filler. In other words, this effect of the filler is suggestful of the fact that if a same resistor is prepared, it is possible to obtain a resistor built-in spark plug having a desired resistivity by using a filler. It will be thus understood that use of a filler is of great significance in practical use.

The number of experiments conducted in connection with this modification of the first embodiment is small as compared with that in the first embodiment, but this is due to the fact that the present inventors have practiced this modification on the basis of the first embodiment. Therefore, the softening temperature of glass to be added in the main resistor mixture (containing tin oxide), the amount of glass to be added, and the softening temperature of glass used in the copper-glass layers of electrode are of course same as those in the first embodiment.

Now, the second and third embodiments of the present invention are described. In the second embodiment, there were prepared glass powders (wholly passing 200-mesh screen) of specimen Nos. 4, 5, 9 and 14 in Table 1 as well as a main resistor mixture containing tin oxide added with 3 wt percent of antimony oxide and 10 wt percent of tantalum oxide, then burned at 1200°C and then pulverized. Thereafter, each of said glass specimens and the main resistor mixture were collected in suitable measured amounts and mixed well in a ball mill. There were also prepared copper powder (all passing 200-mesh screen) and glass of specimen Nos. 1 to 3 of Table 1, and both were mixed at the respectively predetermined rates to obtain mixture powders. Then the mixture of said copper powder and glass and was first charged onto the center electrode 6 in the hole 1*a* in the insulator 1 and then the mixture of tin oxide-containing main resistor mixture and glass was charged thereon, followed by additional charging thereon of a mixture same in composition as but different in amount of copper powder added from said mixture and further application thereon of said mixture. Thereafter, the middle stem 2 was inserted topwide into the hole 1a and then subjected to hot press, thereby forming said mixtures into the first, second and third copper-glass layers 4*a*, 4*b* nd 5' and the resistor mixture into the resistor 3 as shown in FIG. 2. Then tests were conducted to see what features will come out with change of the amount of copper in the first copper-glass layer 4*a* which is in contact with the upper side of the resistor 3, and the results are shown in Table 4. The results of tests same as in the first embodiment are also shown in Table 4. As apparent from this table, if the amount of copper in the first copper-glass layer 4*a* contacting the upper side of the resistor 3 is greater than the amount of copper in the second copper-glass layer 4*b* on said first copper-glass layer 4*a* and the softening point of glass to be added to the main resistor mixture containing tin oxide is lower than 600°C and also if the amount of glass added to said main resistor mixture is within the range of 25 to 62 volume percent of said mixture, the variations in resistivity of the obtained spark plugs are as equally limited as the resistor built-in spark plugs obtained in the first embodiment, and also change of resistivity after the spark discharge test, heating test and engine endurance test is very small. Usually, the copper-glass layers contacting the center electrode 6 and middle stem 2 are required to have the following properties: electroconductivity, pressure resistance and air-tightness so as to withstand gas pressure from the internal combustion engine and to maintain airtightnness, and ability to ensure mechanical solidity of the center electrode 6 and middle stem 2 and dispersion of heat. It is known that, for providing such properties, each copper-glass layer must contain copper in an amount of 10 to 35 volume percent of glass. In this embodiment of the present invention, the copper-glass layer between the resistor 3 and the middle stem 2 is divided into two sub-layers, and it is essential that the amount of copper in the first copper-glass layer 4*a* contacting the upper side of the resistor is greater than the amount of copper in the second layer 4*b* contacting the middle stem 2, so that the rate of copper to glass must be higher than the above-said range of 10 to 35 volume percent. It was, however, found that there is a certain threshold limit for obtaining any significant result, that is, it was found that although not clearly shown in Table 4, the above-said effect can not be produced unless copper is blended in an amount of more than 30 volume percent of glass. Therefore, if copper is blended in the second copper-glass layer 4*b* in an amount of 10 volume percent of glass in said layer 4*b*, it suffices tp blend copper in the first copper-glass layer 4*a* in an amount of more than 30 volume percent of glass in said layer 4*a*. However, if the amount of copper blended in the second copper-glass layer 4b on the side of the middle stem 2 is 30 volume percent of glass in said layer 4*b*, it is obviously quite meaningless to blend copper in the first copper-glass layer 4*a* in an amount of 30 volume percent of glass in said layer 4*a*. Therefore, in case the amount of copper in the second copper-glass layer 4*b* on the middle stem side is greater than 10 volume percent but smaller than 30 volume percent of glass in said layer 4*b*, it will do for the purpose to blend copper in the first layer 4*a* in an amount of 30 volume percent of glass in said layer 4*a*, but in case the amount of copper in the second layer 4*b* is 30 volume percent of glass in said layer 4*b*, the amount of copper blended in the first layer 4*a* contacting the upper side of the resistor 3 must be greater than 30 volume percent of glass in said layer 4*a*. Therefore, as apparent from Table 4, if copper is blended in the first layer 4*a* in an amount of above-said volume percent of glass in said layer 4*a*, change of resistivity after the spark discharge test, heating test and engine endurance test is extremely limited, and further, even when using glass with high coefficient of expansion (such as glass of specimen No. 14 where $\alpha = 14.0 \times 10^{-6}/°C$), the percent defective, or the rate of defective articles whose resistivities are outside the range of 5 KΩ ± 30% (3.5 to 6.5 KΩ) is 11 percent, that is, 11 out of every 100 articles manufactured. This is a marked improvement as compared with 45 percent defectives resulting from use of glass of specimen No. 14 as shown in Table 2. The number of experiments in this second embodiment is small as compared with that in the first embodiment, but this is due to the fact that the second embodiment was practiced on the basis of the first embodiment. Therefore, the softening temperature of glass to be added to the main resistor mixture containing tin oxide, the amount of glass to be added, and the softening temperature of glass in the first, second and third copper-glass layers are all same as those in the first embodiment.

If glass with high coefficient of expansion is used as glass component of the resistor 3, the difference of thermal expansion in the resistor 3 is further added to the difference of thermal expansion between the insulator 1 and the middle stem 2, so that thermal stress develops in the middle stem 2 in the cooling step after manufacture of the spark plug to pull the copper-glass layer which contacts the middle stem 2, with the result that cracks are produced in said copper-glass layer or in the juncture of said layer and the resistor, and this causes variations in resistivity such as above-said. Such problem, however, is eliminated according to this second embodiment of the invention for the following reasons. That is, if the amount of copper contained in the first copper-glass layer 4*a* contacting the resistor 3 is increased as compared with the amount of copper in the second layer 4*b* contacting the stem 2, the amount of glass in said layer 4*a* is naturally decreased to invite reduction of mutual bonding strength of the copper particles. Consequently, cracks develop in the first copper-glass layer 4*a* containing greater amount of copper owing to tensile force produced by thermal expansion of the middle stem 2, and such cracks mitigate said tensile force to an extent where such force can no longer exert any influence to the resistor 3. Therefore, even if cracks are produced in the first copper-glass layer 4*a* where copper is abundant, copper, for its excellent malleability, extends out in conformity to such cracks to bridge the cracked portion, thus securing current passage between the stem 2 and the center electrode 6.

Now, the third embodiment of the present invention is described. There were prepared fine particles of glass (all passing 200-mesh screen) of specimen Nos. 4, 5, 19 and 20 of Table 1, and a powdery main resistor mixture containing tin oxide added with 3 wt percent of antimony oxide and 10 wt percent of tantalum oxide, then burned at 1200°C and then pulverized. Each of said glass specimens and the pulverized main resistor mixture containing tin oxide were collected in suitable measured amounts, and then they were well mixed up in a ball mill to obtain resistor mixture. There were also prepared copper powder (wholly passing 200-mesh screen) and pulverized glass of specimen Nos. 1 and 3 of Table 1, and then said copper powder and pulverized glass of each specimen were mixed at the respectively predetermined rates to obtain mixture powders. Then, one of said mixture powders was charged onto the center electrode 6 in the hole 1*a* in the insulator 1, then another mixture powder different in amount of copper from the first-said mixture powder was charged thereon, and then said resistor mixture was charged on said another mixture powder, this being followed by additional charge thereon of still another mixture powder different in copper amount from the previous mixture powders and final charge thereon of the first-said mixture powder, as shown in FIG. 3. Thereafter, the middle stem 2 was inserted topwise into said hole 1a and subjected to hot press, thereby forming said respective mixture powders into the first, second, third and fourth copper-glass layers 4*a*, 4*b*, 5*a* and 5*b*, and the resistor mixture into the resistor 3 as shown in FIG. 3. Then experiments were carried out to see how the effects vary with change of the amount of copper in the first and third copper-glass layers 4*a* and 5*a* contacting the upper and lower sides of the resistor 3. The results of these experiments are given in Table 4 along with the results of the tests same as conducted in the first embodiment. As apparent from this table, the above-discussed third embodiment produces as excellent results as in the first and second embodiments. The results after the spark discharge test, heating test and engine endurance test are also satisfactory. In this third embodiment, too, it is essential that the amount of copper blended in the first andd third copper-glass layers 4*a* and 5*a* is within the pefectly same range of volume percent (of glass in said respective layers 4*a* and 5*a*) as in the second embodiment. The number of experiments in this third embodiment is small as compared with that in the first embodiment, but this is due to the fact that the third embodiment was practiced on the basis of the first and second embodiments. Therefore, the softening temperature of glass to be added to the main resistor mixture containing tin oxide, the amounts of glass to be added, and the softening temperature of glass in the first, second, third and fourth copper-glass layers 4*a*, 4*b*, 5*a* and 5*b* are all completely same as those in the first embodiment.

Table 1

| Glass Specimen No. | Components and Properties of Various Types (Specimens) of Glass Used Composition (wt %) | | | | | | | | | | | Thermal expansion ($\times 10^{-6}$/°C) | Softening temperature (°C) |
|---|---|---|---|---|---|---|---|---|---|---|---|---|---|
| | $Na_2O$ | $K_2O$ | CaO | MgO | $B_2O_3$ | $Al_2O_3$ | $SiO_2$ | PbO | $TiO_2$ | ZnO | $P_2O_5$ | | |
| 1 | 7 | | | | 2.3 | 16 | 64 | | | | | 4.3 | 590 |
| 2 | 6 | 2.5 | 3.5 | | 13 | 16 | 59 | | | | | 7.4 | 570 |
| 3 | 9 | | | | | 5 | 72 | | | | | 6.0 | 760 |
| 4 | | | | | 17.3 | | | 82.7 | | | | 11.3 | 360 |
| 5 | | | | | 11 | 11 | 3 | 75 | | | | 8.3 | 440 |
| 6 | | | | | 30 | | | 70 | | | | 8.6 | 448 |
| 7 | | | | | 31.7 | | | 68.3 | | | | 8.6 | 451 |
| 8 | | | | | 34.9 | | | 65.1 | | | | 7.9 | 493 |
| 9 | | | | | 44.6 | | | 55.4 | | | | 6.3 | 540 |
| 10 | | | | | 75 | | | 25.0 | | | | 5.7 | 705 |
| 11 | 9.5 | | | | 39.2 | | 43.2 | | 8.1 | | | 6.6 | 730 |
| 12 | 28.0 | | | | 41.9 | | 18.1 | | 12.0 | | | 13.2 | 580 |
| 13 | 18.4 | | | | 3.8 | | 34.2 | | 33.6 | | | 10.3 | 700 |
| 14 | 39 | | | | 32 | | 14 | | 15 | | | 14.0 | 500 |
| 15 | | | | $V_2O_5$ 10 | 30 | | | | | 60 | | 5.2 | 440 |
| 16 | | | | $V_2O_5$ 30 | 20 | | | | | 50 | | 5.1 | 480 |
| 17 | | | | 10 | 50 | | | | | 40 | | 5.2 | 576 |
| 18 | | | | | 45 | | | | | 55 | | 4.6 | 620 |
| 19 | 14 | | | | 14 | 15.5 | | | | | 33.5 | 12.4 | 360 |
| 20 | | | 10 | 4 | 4 | 12 | | | | | 70 | 13.5 | 400 |
| 21 | | | 10 | 10 | 30 | 10 | | | | | 40 | 8.0 | 530 |
| 22 | | | | 13.6 | 38.1 | 21.7 | | | | | 21.6 | 6.1 | 700 |

Table 2–1

| Specimen No. in Copper-glass Layers of electrode | Resistor portion | | Results | | | | |
|---|---|---|---|---|---|---|---|
| | Glass Specimen No. of Table 1 | Amount of glass blended (volume %) | Average resistivity (KΩ) of every 100 pieced of resistor built-in spark plugs manufactured | Fraction defective (%) (Rate of the defective articles whose resistivities are outside the range of 3.5 to 6.5 KΩ) | Rate of change of average resistivity after one-minute spark discharge test (%) | Rate of change of average resistivity after heating test (%) | Rate of change of average resistivity after engine endurance test (%) |
| 1 | 1 | 50 | 6 | 50 | 6 | 8 | 7 |
| 1 | 2 | 50 | 6 | 25 | 5 | 4 | 5 |
| 1 | 2 | 57 | 6.3 | 27 | 5 | 5 | 5 |
| 1 | 2 | 64 | 6.5 | 60 | 20 | 15 | 10 |
| 1 | 4 | 50 | 5.8 | 25 | 5 | 4 | 20 |
| 1 | 5 | 50 | 5.1 | 5 | 5 | 3 | 5 |

Table 2–1-continued

| Specimen No. in Copper-glass Layers of electrode | Resistor portion: Glass Specimen No. of Table 1 | Resistor portion: Amount of glass blended (volume %) | Results: Average resistivity (KΩ) of every 100 pieced of resistor built-in spark plugs manufactured | Results: Fraction defective (%) (Rate of the defective articles whose resistivities are outside the range of 3.5 to 6.5 KΩ) | Results: Rate of change of average resistivity after one-minute spark discharge test (%) | Results: Rate of change of average resistivity after heating test (%) | Results: Rate of change of average resistivity after engine endurance test (%) |
|---|---|---|---|---|---|---|---|
| 1 | 5 | 40 | 5.0 | 6 | 5 | 3 | 5 |
| 1 | 5 | 27 | 5.3 | 7 | 5 | 10 | 3 |
| 1 | 5 | 57 | 5.7 | 5 | 5 | 4 | 5 |
| 1 | 5 | 64 | 6.7 | 50 | 15 | 10 | 8 |
| 1 | 6 | 47 | 5.1 | 4 | 5 | 5 | 5 |
| 1 | 7 | 40 | 5.0 | 5 | 4 | 5 | 6 |
| 1 | 8 | 55 | 5.3 | 5 | 5 | 4 | 7 |
| 1 | 9 | 50 | 5.1 | 5 | 5 | 5 | 5 |
| 1 | 9 | 64 | 6.8 | 52 | 15 | 11 | 7 |
| 1 | 10 | 47 | 6.3 | 60 | 5 | 20 | 21 |
| 1 | 11 | 50 | 6.5 | 70 | 7 | 20 | 21 |
| 1 | 12 | 50 | 5.8 | 65 | 5 | 5 | 6 |
| 1 | 13 | 47 | 6.5 | 60 | 5 | 21 | 20 |
| 1 | 14 | 47 | 5.9 | 45 | 5 | 5 | 5 |
| 3 | 1 | 50 | 6.0 | 8 | 6 | 7 | 7 |
| 11 | 2 | 50 | 6.1 | 7 | 5 | 5 | 4 |
| 3 | 10 | 45 | 6.2 | 20 | 5 | 21 | 22 |
| 3 | 11 | 50 | 6.2 | 28 | 7 | 20 | 21 |
| 3 | 13 | 50 | 6.4 | 30 | 6 | 22 | 20 |
| 3 | 18 | 50 | 6.1 | 25 | 7 | 17 | 19 |
| 3 | 22 | 45 | 6.1 | 23 | 6 | 21 | 21 |
| 1 | 3 | 45 | 6.5 | 70 | 7 | 25 | 25 |

Table 2–2

| Specimen No. in Copper-glass Layers of electrode | Resistor portion: Glass Specimen No. of Table 1 | Resistor portion: Amount of glass blended (volume %) | Results: Average Resistivity (KΩ) of every 100 pieced of resistor built-in spark plugs manufactured | Results: Fraction defective (%) (Rate of the defective articles whose resistivities are outside the range of 3.5 to 6.5 KΩ) | Results: Rate of change of average resistivity after one-minute spark discharge test (%) | Results: Rate of change of average resistivity after heating test (%) | Results: Rate of change of average resistivity after engine endurance test (%) |
|---|---|---|---|---|---|---|---|
| 1 | 15 | 27 | 5.4 | 6 | 5 | 10 | 8 |
| 1 | 15 | 33 | 5.0 | 5 | 5 | 4 | 5 |
| 1 | 15 | 55 | 5.9 | 5 | 5 | 5 | 7 |
| 1 | 16 | 64 | 7.0 | 55 | 15 | 12 | 8 |
| 1 | 16 | 50 | 4.8 | 5 | 4 | 5 | 4 |
| 1 | 17 | 50 | 6.0 | 35 | 7 | 5 | 7 |
| 1 | 13 | 50 | 6.2 | 55 | 6 | 19 | 20 |
| 1 | 18 | 38 | 4.5 | 50 | 5 | 20 | 20 |
| 1 | 19 | 50 | 5.8 | 45 | 6 | 5 | 7 |
| 1 | 20 | 50 | 6.0 | 50 | 7 | 5 | 6 |
| 1 | 21 | 50 | 4.7 | 5 | 5 | 4 | 4 |
| 1 | 22 | 42 | 6.4 | 55 | 7 | 23 | 24 |
| 2 | 5 | 50 | 5.0 | 5 | 5 | 4 | 6 |
| 3 | 5 | 57 | 5.5 | 4 | 5 | 4 | 6 |
| 3 | 9 | 50 | 5.2 | 5 | 4 | 5 | 5 |
| 3 | 16 | 38 | 5.0 | 5 | 6 | 5 | 7 |
| 1 | 5 | 20 | 4.5 | 10 | 6 | 5 | 8 |
| 1 | 5 | 15 | 4.0 | 10 | 8 | 5 | 8 |
| 1 | 5 | 12 | 4.0 | 15 | 10 | 14 | 10 |
| 1 | 5 | 10 | 3.8 | 30 | 50 | 16 | 12 |
| 9 | 21 | 50 | 5.2 | 45 | 5 | 5 | 5 |
| 2 | 1 | 50 | 6.3 | 50 | 7 | 9 | 6 |
| 18 | 1 | 50 | 6.0 | 11 | 7 | 8 | 6 |
| 9 | 1 | 50 | 6.3 | 55 | 8 | 7 | 8 |
| 2 | 2 | 50 | 6.1 | 50 | 5 | 5 | 5 |
| 22 | 2 | 50 | 6.0 | 10 | 5 | 5 | 6 |
| 21 | 9 | 50 | 5.1 | 48 | 5 | 6 | 7 |
| 2 | 9 | 45 | 5.2 | 10 | 5 | 4 | 6 |
| 3 | 12 | 38 | 5.3 | 45 | 5 | 5 | 5 |
| 2 | 17 | 50 | 6.8 | 60 | 7 | 6 | 7 |
| 3 | 17 | 50 | 6.2 | 10 | 6 | 5 | 5 |
| 9 | 21 | 50 | 5.0 | 38 | 6 | 5 | 5 |
| 2 | 21 | 50 | 4.8 | 6 | 6 | 5 | 6 |

Table 2–3

| Specimen No. in Copper-glass Layers of electrode | Resistor portion | | Results | | | | |
|---|---|---|---|---|---|---|---|
| | Glass Specimen No. of Table 1 | Amount of glass blended (volume %) | Average resistivity (KΩ) of every 100 pieces of resistor built-in spark plugs manufactured | Fraction defective (%) (Rate of the defective articles whose resistivities are outside the range of 3.5 to 6.5 KΩ) | Rate of change of average resistivity after one-minute spark discharge test (%) | Rate of change of average resistivity after heating test (%) | Rate of change of average resistivity after engine endurance test (%) |
| 1 | 5 | 43 | 4.5 | 10 | 5 | 5 | 5 |
| 1 | " | 55 | 4.8 | 8 | 6 | 4 | 5 |
| 1 | " | 62 | 5.2 | 12 | 8 | 5 | 5 |
| 1 | " | 20 | 3.5 | 80 | 8 | 25 | 15 |
| 1 | " | 38 | 4.3 | 8 | 5 | 4 | 5 |
| 1 | " | 49 | 4.5 | 5 | 5 | 3 | 8 |
| 1 | " | 57 | 5.2. | 15 | 4 | 6 | 7 |
| 1 | " | 63 | 6.8 | 63 | 8 | 20 | 10 |
| 1 | " | 33 | 4.0 | 15 | 7 | 7 | 5 |
| 1 | " | 44 | 4.5 | 10 | 6 | 6 | 5 |
| 1 | " | 52 | 5.6 | 10 | 7 | 5 | 8 |
| 1 | " | 14 | 2.2 | 90 | 5 | 35 | 20 |
| 1 | " | 40 | 4.5 | 12 | 8 | 5 | 7 |
| 1 | " | 48 | 5.6 | 10 | 7 | 8 | 8 |
| 1 | " | 12 | 2.0 | 98 | 10 | 35 | 25 |
| 1 | " | 25 | 5.3 | 15 | 5 | 10 | 8 |

Table 3

| Specimen No. of glass in the copper-glass layers | Filler | | Resistor portion | | Results | | | | |
|---|---|---|---|---|---|---|---|---|---|
| | Material | Quantity (wt%) | Glass specimen No. of Table 1 | Amount of glass blended (volume %) | Average resistivity (KΩ) of every 100 pieces of resistor built-in spark plugs manufactured | Fraction defective (%) (Rate of defective articles whose resistivities are outside the range of 3.5 to 6.5 KΩ) | Rate of change of average resistivity after one-minute spark discharge test (%) | Rate of change of average resistivity after heating test (%) | Rate of change of average resistivity after engine endurance test (%) |
| 1 | F.Q. | 20 | 5 | 47 | 5.5 | 5 | 5 | 4 | 5 |
| 1 | $ZrO_2$ | " | " | 48 | 5.4 | 5 | 5 | 4 | 5 |
| 1 | $ZrO_2$ $SiO_2$ | " | " | 48 | 5.5 | 5 | 6 | 5 | 4 |
| 1 | " | " | 8 | 35 | 5.2 | 5 | 5 | 5 | 7 |
| 1 | " | " | " | 53 | 5.7 | 8 | 5 | 4 | 6 |
| 1 | " | " | " | 63 | 7.5 | 80 | 20 | 12 | 10 |
| 1 | F.Q. | " | 4 | 47 | 5.6 | 15 | 5 | 5 | 8 |
| 3 | " | " | 12 | 47 | 5.7 | 18 | 5 | 5 | 5 |
| 1 | F.Q. | 20 | 14 | 47 | 5.6 | 20 | 5 | 5 | 6 |
| 1 | " | " | 14 | 23 | 5.8 | 8 | 5 | 20 | 7 |
| 1 | " | " | 20 | 41 | 5.1 | 12 | 5 | 5 | 6 |
| 1 | " | 30 | 20 | 40 | 8.0 | (98) | 5 | 5 | 7 |
| 1 | " | 20 | 5 | 27 | 5.6 | 7 | 5 | 10 | 8 |

(Note)
F.Q. = quartz glass
$ZrO_2$ = zirconia
$ZrO_2.SiO_2$ = zircon

Table 4

| | Copper-glass Layer portion of electrode | | | | | | | | Resistor | |
|---|---|---|---|---|---|---|---|---|---|---|
| | Second copper-glass layer 4b | | First copper-glass layer 4a | | Third copper-glass layer 5', 5a | | Fourth copper-glass layer 5b | | | |
| | Glass specimen No. | Amount of copper blended (volume%) | Glass specimen No. | Amount of copper blended (volume%) | Glass specimen No. | Amount of copper blended (volume%) | Glass specimen No. | Amount of copper blended (volume%) | Glass specimen No. of Table 1 | Amount of glass blended (volume%) |
| Second embodiment | 1 | 23 | 1 | 41 | — | — | 1 | 23 | 5 | 50 |
| | 1 | 10 | 1 | 41 | — | — | 1 | 10 | 5 | 50 |
| | 1 | 23 | 2 | 53 | — | — | 1 | 23 | 5 | 50 |
| | 1 | 23 | 2 | 30 | — | — | 1 | 23 | 9 | 50 |
| | 1 | 23 | 1 | 53 | — | — | 1 | 23 | 4 | 50 |
| | 1 | 23 | 1 | 30 | — | — | 1 | 23 | 4 | 50 |
| | 2 | 23 | 2 | 41 | — | — | 1 | 23 | 14 | 50 |
| Third embodiment | 3 | 23 | 3 | 53 | 3 | 53 | 3 | 23 | 20 | 50 |
| | 3 | 20 | 3 | 30 | 3 | 30 | 3 | 20 | 19 | 50 |
| | 1 | 10 | 1 | 53 | 1 | 53 | 1 | 10 | 4 | 50 |
| | 1 | 30 | 1 | 53 | 1 | 53 | 1 | 30 | 4 | 50 |
| | 1 | 23 | 1 | 53 | 1 | 53 | 1 | 23 | 4 | 50 |
| | 1 | 23 | 1 | 74 | 1 | 74 | 1 | 23 | 5 | 50 |

Table 4-continued

| Average resistivity (KΩ) of every 100 pieces of resistor built-in spark plugs manufactured | Fraction defective (%) (Rate of defective articles whoes resistivities are outside the range of 3.5 to 6.5 KΩ) | Results Rate of change of average resistivity after one-minute spark discharge test (%) | Rate of change of average resistivity after heating test (%) | Rate of change of average resistivity after engine endurance test (%) |
|---|---|---|---|---|
| 5.0 | 5 | 5 | 3 | 5 |
| 5.1 | 5 | 5 | 4 | 5 |
| 5.1 | 5 | 5 | 3 | 5 |
| 5.0 | 5 | 4 | 4 | 5 |
| 5.4 | 12 | 5 | 5 | 7 |
| 5.3 | 12 | 5 | 5 | 6 |
| 5.5 | 11 | 5 | 4 | 6 |
| 5.7 | 15 | 6 | 6 | 7 |
| 5.5 | 12 | 5 | 5 | 6 |
| 5.3 | 11 | 5 | 5 | 6 |
| 5.3 | 11 | 5 | 5 | 6 |
| 5.4 | 5 | 5 | 5 | 5 |
| 5.0 | 5 | 5 | 3 | 5 |

The volume percent of glass blended into the main resistor mixture containing tin oxide was found from the results of our experiments and determined to take certain specified times of void volume of said mixture.

In each of the foregoing embodiments of the invention, there have been obtained the resistor built-in spark plugs having resistivity of 5 KΩ ± 1.5 KΩ as apparent from the tables given for the respective embodiments, but it is possible to obtain the spark plugs having resistivities of other ranges, for example 10 KΩ ± 3 KΩ and 15 KΩ ± 4.5 KΩ, by suitably changing the rate of tin oxide contained in the resistor and the amounts of additives such as tantalum oxide. In these cases, the amount of glass added to the main resistor mixture containing tin oxide and the softening point of such glass are of course within the above-defined ranges.

What is claimed is

1. A resistor built-in spark plug comprising an insulator formed with an axially extending inner hole, a stem fitted in the upper part of said hole in said insulator, a center electrode fitted in the lower part of said hole, a resistor disposed in the central part of said hole, and copper-glass electrode layers disposed between said resistor and said stem and between said resistor and said center electrode, said resistor being made by firing and solidifying powder of resistor mixture consisting of 75 to 38 volume percent of main resistor component containing tin oxide and 25 to 62 volume percent of glass powder with softening temperature of 300° to 600°C, and said copper-glass electrode layers being made by firing and solidifying a mixture of copper powder and glass powder with the softening temperature of above 530°C and more than 30°C higher than the softening point of glass in the resistor portion.

2. A resistor built-in spark plug comprising an insulator formed with an axially extending inner hole, a stem fitted in the upper part of said hole in said insulator, a center electrode fitted in the lower part of said hole, a resistor disposed in the central part of said hole, a first copper-glass electrode layer disposed between said resistor and said stem and in contact with said stem, a second copper-glass electrode layer disposed in contact with said resistor and containing a greater amount of copper than said first copper-glass layer, and a third copper-glass electrode layer disposed between said resistor and said center electrode, said resistor being made by firing and solidifying powder of resistor mixture consisting of 75 to 38 volume percent of main resistor component containing tin oxide and 25 to 62 volume percent of glass powder with softening temperature of 300° to 600°C, said first and third copper-glass layers being made by firing and solidifying a mixture of 10 to 35 volume percent of copper powder and 90 to 65 volume percent of glass powder with softening temperature of above 530°C and more than 30°C higher than the softening point of glass in the resistor portion, and said second copper-glass layer being made by firing and solidifying a mixture of copper powder in an amount of more than 30 volume percent and greater than the amount of copper in said first copper-glass layer and remaining percent of glasss powder with softening temperature of above 530°C and more than 30°C higher than the softening temperature of glass in the resistor portion.

3. A resistor built-in spark plug comprising an insulator formed with an axially extending inner hole, a stem fitted in the upper part of said hole in said insulator, a center electrode fitted in the lower part of said hole, a resistor disposed in the central part of said hole, a first copper-glass electrode layer disposed between said resistor and said stem and in contact with said stem, a second copper-glass electrode layer disposed in contact with said resistor and containing a greater amount of copper than said first copper-glass layer, a third copper-glass electrode layer disposed between said resistor and said center electrode and in contact with said center electrode, and a fourth copper-glass electrode layer disposed in contact with said resistor and containing a greater amount of copper than said third copper-glass layer, said resistor being made by firing and solidifying powder of resistor mixture consisting of 75 to 38 volume percent of main resistor component containing tin oxide and 25 to 62 volume percent of glass powder with softening temperature of 300° to 600°C, said first and third copper-glass layers being made by firing and solidifying a mixture of 10 to 35 volume percent of copper powder and 90 to 65 volume percent of glass powder with softening temperature of above 530°C and more than 30°C higher than the softening point of glass in the resistor portion, and said second and fourth copper-glass layers being made by firing and solidifying a mixture comprising more than 30 volume percent of copper powder greater in amount than copper in said first and third copper-glass layers and remaining percent of glass powder with softening temperature of above 530°C and more than 30°C higher than the softening point of glass in the resistor portion.

4. The resistor built-in spark plug according to claim 1, wherein the main component mixture of said resistor contains a filler with extremely high electric resistivity.

5. The resistor built-in spark plug according to claim 4, wherein said filler is one of the following: quartz glass, zirconia and zircon.

6. The resistor built-in spark plug according to claim 2 wherein the main component mixture of said resistor contains a filler with extremely high electric resistivity.

7. The resistor built-in spark plug according to claim 6, wherein said filler is one of the following: quartz glass, zirconia and zircon.

8. The resistor built-in spark plug according to claim 3, wherein the main component mixture of said resistor contains a filler with extremely high electric resistivity.

9. The resistor built-in spark plug according to claim 8 wherein said filler is one of the following: quartz glass, zirconia and zircon.

10. The resistor built-in spark plug according to claim 1 wherein the glass in the copper-glass layers has a softening point lower than 750°C.

11. The resistor built-in spark plug according to claim 2 wherein the glass in the copper-glass layers has a softening point lower than 750°C.

12. The resistor built-in spark plug according to claim 3 wherein the glass in the copper-glass layers has a softening point lower than 750°C.

* * * * *